US006312368B1

(12) United States Patent
Wood et al.

(10) Patent No.: US 6,312,368 B1
(45) Date of Patent: Nov. 6, 2001

(54) CARTON AND METHOD FOR MANUFACTURE THEREOF

(75) Inventors: John Wood; Paul Nixon, both of Chesterfield (GB)

(73) Assignee: A & R Carton (UK) Ltd., Chesterfield (GB)

( * ) Notice: Subject to any disclaimer, the term of this patent is extended or adjusted under 35 U.S.C. 154(b) by 0 days.

(21) Appl. No.: 09/418,338

(22) Filed: Oct. 14, 1999

(30) Foreign Application Priority Data

Oct. 20, 1998 (GB) ..... 9822837

(51) Int. Cl.[7] ..... B31B 1/00
(52) U.S. Cl. ..... 493/52; 493/109; 493/134
(58) Field of Search ..... 156/217, 447, 156/499; 493/109, 134, 52

(56) References Cited

U.S. PATENT DOCUMENTS 4,295,838 * 10/1981 Richards et al. .
4,349,400 9/1982 Gilden ..... 156/217
4,559,092 * 12/1985 Oakley .
4,626,234 * 12/1986 Oxborrow .
5,766,390 * 6/1998 Jensen .
5,925,207 * 7/1999 Itoh et al. .
5,992,489 * 11/1999 Busse .

FOREIGN PATENT DOCUMENTS

0576751A1 1/1994 (EP) ..... B65B/7/18

* cited by examiner

*Primary Examiner*—Eugene Kim
(74) *Attorney, Agent, or Firm*—Head, Johnson and Kachigian

(57) ABSTRACT

This invention relates to a method of manufacturing a carton from a PET coated material having an initially separate base and side wall sections which are adhered together by melting the PET coating when the respective sections are suitably disposed with respect to one another and in contact. Subsequent application of pressure to different areas of one or other of the base and/or side wall sections ensures a secure bond therebetween. The invention lies in the application of heat to the material and/or coating such that only sections of board which are to be bonded together receive sufficient heat to cause melting of the PET coating, the remaining surfaces not being subjected to heat or only to an amount of heat which can be withstood by the PET coating without compromise of the fluid resistant properties of the PET coating. A hot air blast acutely angled to the coating ensures the correct application of heat in the desired areas. Heat-splash and other problems caused by over heating are thus avoided.

16 Claims, 2 Drawing Sheets

CARTON AND METHOD FOR MANUFACTURE THEREOF

CROSS-REFERENCE TO RELATED APPLICATIONS

This application claims priority to G.B. Application No. 9822837.2 filed Oct. 20, 1998.

BACKGROUND OF THE INVENTION

This invention relates to an improved carton and method for manufacture thereof, and more particularly relates to the manufacture of cartons from card and board stock at least which is coated on at least one surface with a Polyethylene terephthalate (PET) layer.

It is to be mentioned that currently single sided PET clay card stock is used in the manufacture of rectangular and square tray-like cartons for containment of foodstuffs which are to be heated prior to consumption either in a conventional oven or in microwave oven, and therefore such cartons are commonly known as double-ovenable cartons.

It has been established that PET has desirable heat resistance properties in that its melting point is approximately 245° C. and therefore can easily withstand the temperatures to which foodstuffs may be raised in such ovens without decomposing or melting and thus impairing said foodstuffs.

In an alternate but associated technical field, cups and other cartons with a cylindrical, or partially or completely arcuate base shape, are conventionally manufactured using board and card stock with at least one coating of polyethylene (PE) thereon and are typically of two-piece construction, in particular a base portion and a side wall portion. PE has excellent fluid retention characteristics, and is therefore ideal for the manufacture of cups and the like which commonly contain cold beverages, but its low melting point (106–109° C.) precludes its use in double-ovenable carton manufacture.

Until now, it has been considered impossible to manufacture a two-piece carton with a partially or completely arcuate base shape from card stock with at least one PET coating on a particular surface of said card stock, and this consideration has been primarily based on the assumption that the various process steps which are conducted on PE coated card during the manufacture of cups and the like could not be applied to PET coated card without significant material degradation.

The perceived difficulties associated with cup technology as applied to PET carton manufacture are fundamentally related to the bonding of the base portion to the side wall portion to provide a substantially hermetically sealed base construction which adequately retains fluid within the carton. This is essential when it is considered that a particular application of the carton according to the invention is to contain either frozen or chilled food products which may have a high water content.

In particular, it is known that the PET coating on conventional card stock has a tendency to shrink back on itself and thus revealing the card substrate to which said coating was applied. This is completely unacceptable for the reasons mentioned above and in that the fluid repellency of the card stock provided by the PET layer is unacceptably compromised.

Although not an essential requirement of the manufacture of PE cups and the like, it is preferable that the said cups be manufactured without the need for separate adhesives and thus heat is generally applied, either by hot air or by sonication to the card to melt the PE layer which ultimately bonds the base portion of the cup to the side walls, and also bonds the seam where the side wall portion is overlapped. This method of bonding is most expedient, increases the efficiency of the process and the rate at which cups can be produced, and furthermore is beneficial to the fluid retention characteristics of the resulting cup because PE has a tendency to "flow" when molten as opposed to the shrinking characteristic associated with PET. The fluidity of molten PE is of advantage in two respects. Firstly, the molten PE material can flow into channels formed between the base portion and the side wall portion of the cup as it is being formed and so improve its fluid retention characteristics, and secondly, the fluid repellency of both the base portion and the side wall portion internally of the cup are not compromised significantly if the heat is inaccurately applied around the contact location between the base portion and the side wall portion.

With particular regard to the second of these advantages, it is to be pointed out that the shrinkage of PET gives rise to "pin-holing" in the PET coating, and areas of what is termed "heat splash" are visible internally of the cup on the side walls proximate the base.

Arising from the sealing difficulties mentioned above, experimentation has shown that conventional base construction as currently practised in cup manufacture, but using PET coated card can result in fluid leakage through the channels formed between the base portion and side wall portion internally of the cup. Again for the reasons mentioned above, this is unacceptable for PET cartons which are to hold fluids. Furthermore, the increased melting temperature of PET as compared to PE precludes the use of sonication as a means for melting PET.

The object of the invention is to provide a method and means for manufacture of double-ovenable two-piece cartons from card or board stock provided with a coating of PET on at least side thereof which mitigates against the disadvantages described above.

It is a further object of this invention to provide a carton manufactured from card or board stock provided with a coating of PET on at least side thereof which is of rigid and watertight construction which can nevertheless be manufactured in quick repeated succession.

It is a yet further object of this invention to provide a modified base construction for a PET two-piece construction carton which provides increased nigidity for the carton and furthermore is less prone to leakage.

SUMMARY OF THE INVENTION

According to the invention there is provided a method of manufacturing a carton, said carton being constructed of a base and a side wall, both of said base and side wall being formed of card coated on at least one side with PET, said base having a flange around its periphery to which said side wall may be adhered to form the carton, the method comprising the steps of first heating regions proximate an edge of the side wall by subjecting said regions to a blast of air at a temperature sufficient to melt said PET coating in said regions, and subsequently bringing said flange of said base into contact with said melted PET coating in said region, characterised in that the direction of air blast subtends an angle θ° with the plane containing the side wall, θ° being acute and the flange of the base being brought into contact with said region such that the PET coating is substantially unimpaired above the base internally of the carton.

Preferably the base is arcuate along at least a portion of its periphery.

Preferably the card of which the base is formed is coated on both sides with PET.

Further preferably the side wall is wrapped around a mandrel of a shape corresponding to the desired shape of the carton, the PET coated side of said side wall adjacent the mandrel, and yet further preferably the edges of said side wall overlap on said mandrel permitting the application of heat along the line of said overlap to melt the PET coating thereat thus forming a bonded seam in the side wall portion. It will be appreciated that the bond is effected between the inner PET coated surface and the outer card surface in the region of the seam.

In a most preferred embodiment, the flange of the base is primarily bonded to the side wall at a uniform distance from the lowermost edge of the side wall such that said lowermost edge can be subsequently bent inwardly of the carton and urged and secondarily bonded against the surface of the flange opposite that surface which provides the primary bond.

Preferably the secondary bond is effected by a base expander provided with a number of platens which, when disposed within the cavity defined by the lowermost surface of the base and the lowermost portion of the side wall, are urged outwardly bringing the already bent lowermost edge of the side wall into contact with the surface of the flange opposite that surface which provides the primary bond to form said secondary bond and simultaneously improving the primary bond by urging the flange of the base portion against the side wall portion in the region of said primary bond.

Preferably the platens of the base expander overlap in such a manner that a substantially uniform pressure is applied thereby to the flange of the base portion.

In the case where a bead is to be provided around the uppermost edge of the side wall of the carton, the method further preferably also includes the steps of applying a lubricant in the region of said uppermost edge, and substantially simultaneously flaring said uppermost edge outwardly of the carton, pre-curling said uppermost edge, optionally further pre-curling said uppermost edge, and applying a finishing curl to said uppermost edge such that said uppermost edge is urged back underneath itself to form said bead.

According to a further aspect of the invention there is provided a double-ovenable carton constructed of a base and a side wall, both of said base and side wall being formed of card coated on at least one side with PET, said base having a flange around its periphery to which said side wall may be adhered to form the carton, characterised in that the carton is of two-piece construction, and in that the PET coating of the side wall is substantially unimpaired above the level of the base internally of the carton.

Preferably the base of the carton punched from a web of base material. In a most preferred embodiment, the base is a laminate construction having an additional layer of a susceptor, shielding or other material having radiation induced activity or inactivity characteristics.

Alternatively, an "in-line" punching mechanism may be used to punch a base from a web of base material and additionally punch a susceptor/shielding material blank having similar shape and dimensions to the base from an adjacent web of susceptor/shielding material.

Preferably, the side wall is provided with a laminar coating of a susceptor/shielding type material.

Preferably the base and/or side wall are provided with susceptor/shielding type material over in only a predetermined portion of their area which is accessible internally of the carton. In this manner a carton can be provided having different heating requirements.

In a most preferred embodiment, the sucseptor/shielding material is sandwiched between the layer of PET and the board substrate of which the base and/or side wall of the carton is comprised.

It will be appreciated by those skilled in the art that the above represents a significant departure from conventional PE carton manufacturing methods, and that a number of advances have been required to adapt existing cup technology to the use of PET coated materials.

It is also to be mentioned that the use of a susceptor/shielding type material increases the heat generated on a particular inner surface of the carton which may contact the food product contained therein. A browning/improved cooking effect can thus be achieved which the carton and contents are subjected to microwave radiation. This also has the effect of eliminating cold spots which can sometimes result from non-uniform freezing of the foodstuff within the carton and the random nature of microwave energy transmission within microwave ovens.

BRIEF DESCRIPTION OF THE DRAWINGS

A specific embodiment of the invention will now be described by way of example with reference to the accompanying drawings wherein.

DETAILED DESCRIPTION OF THE PREFERRED EMBODIMENT

Figure 1:
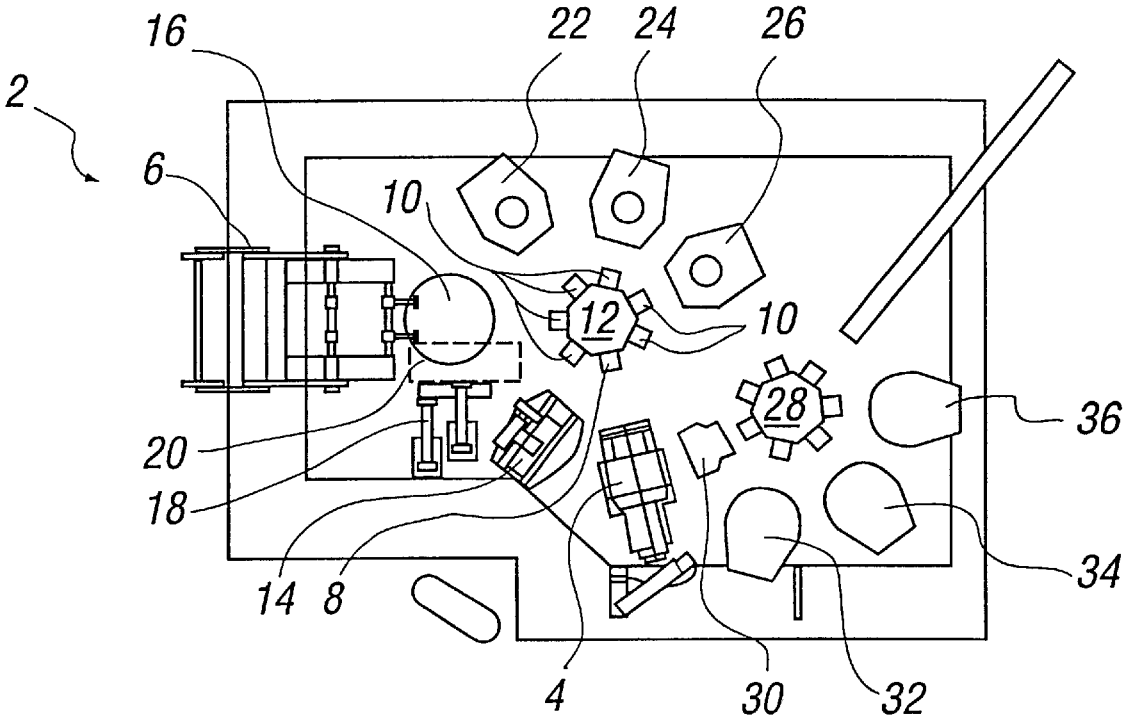
FIG. 1 shows a schematic plan view of a machine carton manufacturing station according to the invention.

Referring firstly to FIGS. 1, there is shown a two-piece construction carton manufacturing machine 2 provided with a base punch 4 which is fed with a web of material (not shown) coated on both sides with PET and from which the base of the carton is fabricated.

A blank in-feed designated generally at 6 receive blanks of card material coated on at least one side with PET and from which the side wall of the carton is ultimately formed.

Once a base portion has been punched from the web of base material by the base punch 4, it is transferred to a cavity of a shape corresponding to that of the base provided within a mandrel 8 being one of a number of identical mandrels 10 being disposed on the faces of a rotating heptagonal mandrel head 12. The base is typically held within the cavity of mandrel 8 by vacuum air pressure.

After the transfer of the base from base punch 4 to the cavity of mandrel 8, the rotating mandrel head 12 rotates such that mandrel 8 faces a base pre-heat unit 14 which softens or melts one of the PET coatings of the base approximate the periphery thereof to render said base more receptive to bonding of the side wall.

Figure 4:
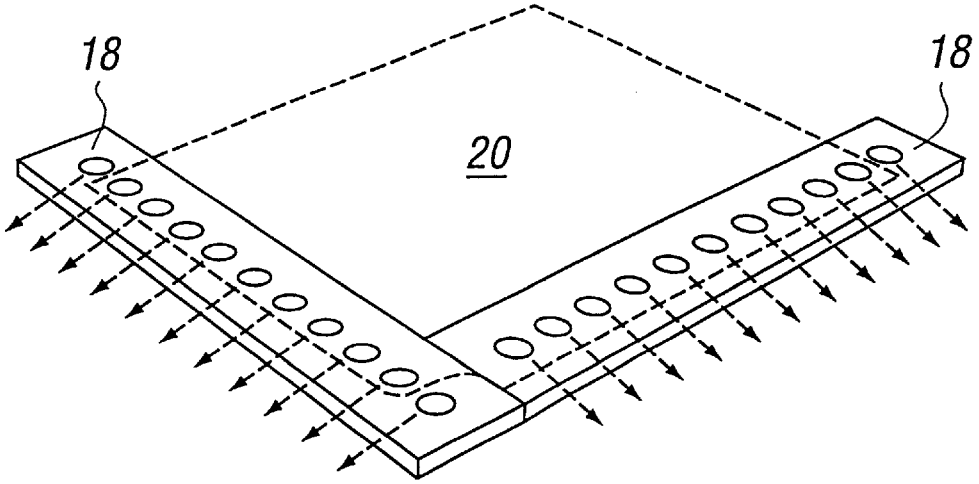
FIG. 4 shows a perspective schematic view of the direction of the air blast over the edges of a blank in accordance with the invention.

The blank in-feed 6 receives blanks one at a time and feeds same through to a feed turret 16 which is adjacent a pair of side wall heaters 18 which are provided with angled holes in their lower surfaces such that hot air passing therethrough strikes the blank held on feed turret 16 approximate edges thereof at an acute angle, and furthermore said hot air is directed parallel to the shortest edges of the blank (one of which is shown at 20 adjacent said side wall heaters 18) in the case where a region of PET parallel with the longest sides of said blank is desired to be melted. It is to be mentioned that the side wall heaters 18 ate in the form of tubular sections in which there are provided a plurality of apertures drilled at a particular angle to direct the hot air flow as required. Said tubular sections may be provided internally with baffle; to ensure a uniform air pressure over the particular edge of the blank 20 which is being heated. Reference may be had to FIG. 4 which more particularly shows the direction of hot air travel over the edges of the side wall blank 20 shown in FIG. 1.

Once the desired edge regions of the blank 20 have been heated and the PET coating within those regions has melted sufficiently, the blank 20 is transferred to a mandrel 10 which subsequently rotates into a position opposite a base heater 22 which effectively forms a primary bond between the side wall positioned around the particular mandrel and the base held within the cavity of that mandrel. It should be mentioned that this primary seal is insufficient to adequately contain fluid within the carton, and therefore a secondary seal is required.

A base pre-curl unit 24 is provided to curl the lowermost edge of the side wall inwardly of the cavity formed in the base of the carton as a result of the primary bond between the flange of the base and the said side wall.

A base expander unit 26 completes the curl initiated by the pre-curl unit 24 and urges the lowermost edge of the side wall against the innermost surface of the flange of the base while simultaneously expanding the base of the carton by urging the flange of said base against the side wall in the region of the primary bond. This completes the formation of the base of the carton and renders said carton substantially watertight in the region of the base thereof.

A bead may be provided on the uppermost edge of the side wall by transferring the partially completed carton from the mandrel which has most recently been subjected to the action of the base expander 26 to a second rotating heptagonal mandrel unit 28, the mandrels of which are arranged to be disposed adjacent a flare tamper lube unit 30, a primary pre-curl unit 32, a secondary pre-curl unit 34, and a finish station 36. The action of the various units 30 to 36 is well known in the art and description is therefore not provided, but it should be noted that modifications which would be obvious to a man skilled in the art have been made to these pieces of apparatus to permit beading of PET coated card as opposed to beading of PE coated card as is currently practised.

Figure 2:
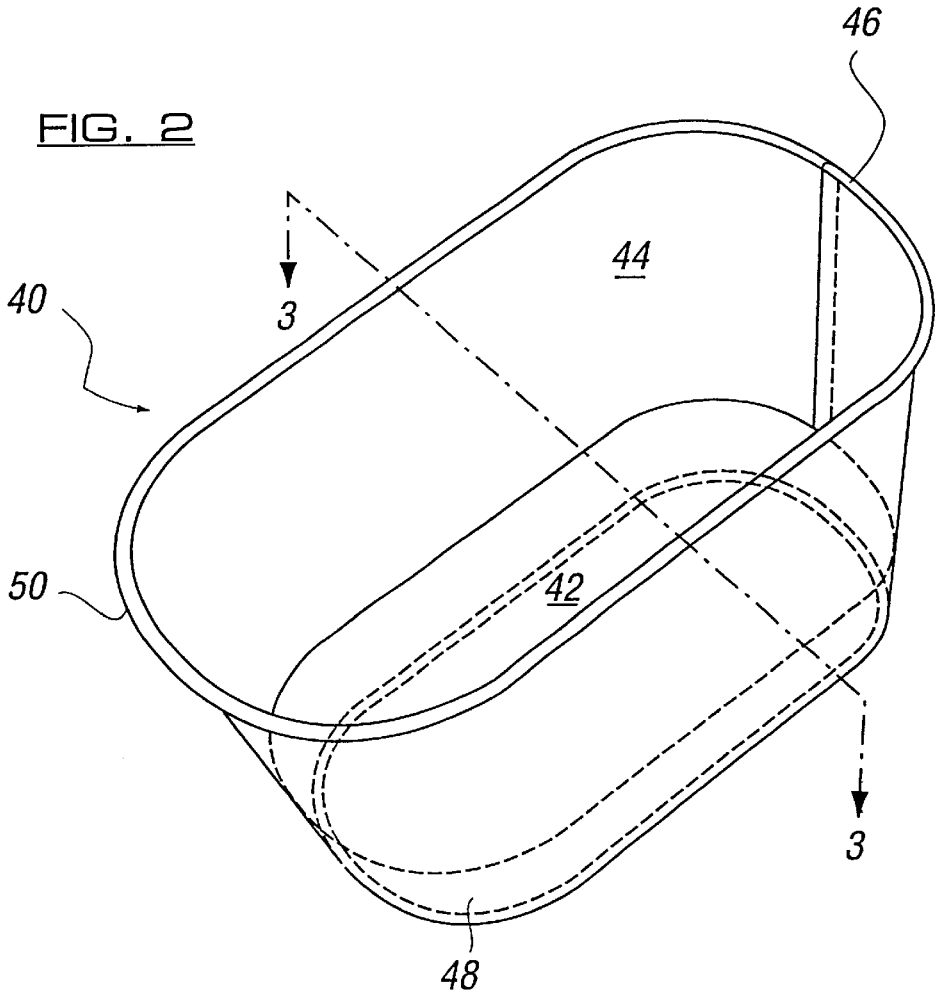
FIG. 2 shows a perspective view of a carton manufactured by the machine of FIG. 1.

Referring now to FIG. 2, there is shown a completed carton 40 constructed of a base 42 and a side wall 44 which has a seam 46 whereat overlapping edges of said side wall 44 have been heat sealed against one another. The carton is constructed such that the PET coated surfaces of the card which constitute the base and side wall are disposed internally of the carton such that products contained within said carton contact these PET coated surfaces.

The base 42 is provided with a flange 48 around its entire periphery and this flange is bonded to the inside surface of the side wall in the primary bonding step during the manufacture of the carton 40. A bead 50 is provided around the entire periphery of the uppermost edge of the side wall 44 to facilitate the attachment of a cover over said carton.

Figure 3:
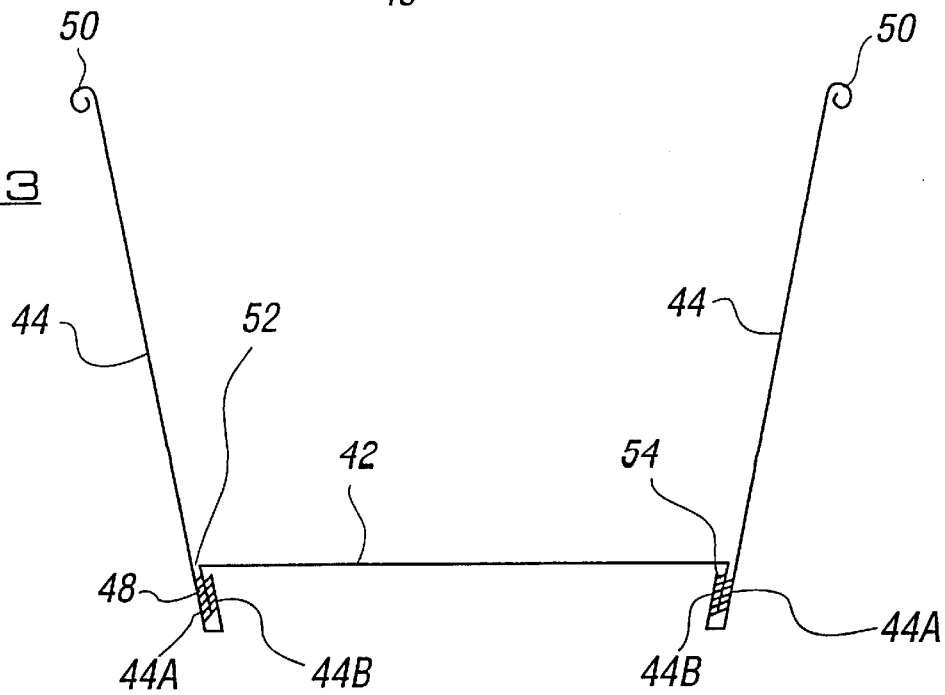
FIG. 3 shows a vertical section through the carton of FIG. 2.

The cross sectional view of the carton of FIG. 2 shown in FIG. 3 clearly demonstrates the base construction, and the particular curled configuration of the bead 50. In particular, it can be seen from FIG. 3 that the flange 48 of the base 42 is encased on either side by portions 44*a*, 44*b* of the side wall 44. Moreover, the primary bond is formed between the outermost surface of the flange 48 and the innermost surface of the portion 44*a* of the side wall 44 as shown at 52, whereas the secondary bond is formed between the innermost surface of the flange 48 and the innermost surface of the portion 44*b* of the side wall 44 as shown at 54. This particular base construction is considered unique, and not only renders the carton of the invention more rigid than other similarly manufactured carton without such a base construction, but also enhances the fluid retention characteristic of the resulting carton.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of manufacturing a carton, said carton having a base and a side wall, said base and side wall being formed from a base blank and a side wall blank of card having a PET coating thereon which melts on heating, the method comprising the steps forming said base blank into said base by forming a flange around the periphery of said base to which said side wall may be adhered to form the carton, heating regions proximate edges of said side wall blank subjecting said regions to a blast of air at a temperature sufficient to melt said coating in said regions, subsequently forming said side wall blank into said side wall by disposing said side wall blank around a mandrel whereon said flange of said base is brought into contact with said side wall and opposite edges of said side wall blank are overlapped, wherein the coating is melted in regions proximate a pair of adjacent edges of the said side wall blank by directing blasts of air towards said edges at angles $\theta°$ where $\theta°$ is acute to adhere both the overlapped said wall blank edges and the flange of the base to the side wall, the coating being substantially unimpaired above the base internally of the carton.

2. A method according to claim 1 wherein said base is arcuate along at least a portion of its periphery.

3. A method according to claim 1 wherein said card is coated on both sides.

4. A method according to claim 1 wherein said flange of said base is primarily bonded to said side wall at a uniform distance from the lowermost edge of said side wall such that said lowermost edge can be subsequently bent inwardly of said carton and urged and secondarily bonded against the surface of said flange opposite that surface which provides the primary bond.

5. A method according to claim 4 wherein said secondary bond is effected by a base expander provided with a number of platens which, when disposed within the cavity defined by the lowermost surface of said base and the lowermost portion of said side wall, are urged outwardly bringing the pre-bent lowermost edge of said side wall into contact with the surface of said flange opposite that surface which provides said primary bond to form said secondary bond and simultaneously improving said primary bond by urging said flange of said base portion against said side wall portion in the region of the said primary bond.

6. A method according to claim 5 wherein said platens of said base expander overlap in such a manner that a substantially uniform pressure is applied thereby to said flange of said base portion.

7. A method according to claim 6 wherein the method further includes the steps of applying a lubricant in the region of said uppermost edge, and substantially simultaneously flaring gsid uppermost edge outwardly of said carton, pre-curling said uppermost edge, optionally further pre-curling said uppermost edge, and applying a finishing curl to said uppermost edge such that said uppermost edge is urged back underneath itself to form said bead.

8. A method according to claim 1 wherein the method further includes the step of further heating the overlapped edges of the side wall while disposed around the mandrel to form a bonded seam in said side wall portion.

9. A double-ovenable carton constructed of a base and a side wall, both of said base and said side wall being formed of card coated on at least one side with PET which melts on heating, said base having a flange around its periphery to which said side wall may be adhered to form the carton, comprising; said carton is of two-piece construction:

means to apply a blast of air to proximate edges of said side wall at a temperature sufficient to melt said PET coating, said air directed towards said edges at angles θ° where θ° is acute to adhere both said side wall edges and said base of said flange; and the coating of said side wall is substantially unimpaired above the level of said base internally of said carton as a result of the application of heat during the formation of said carton, and at least one of said base and said side walls is provided with a layer of a material having radiation activated or inactivated characteristics in addition to the PET and board layers.

10. A carton according to claim 9 wherein the material layer is a susceptor or shielding type material.

11. A carton according to claim 9 wherein at least one of said base and said side wall is laminarly coated with a susceptor/shielding type material.

12. A carton according to claim 11 wherein said base of the carton punched is from a web of base material.

13. A carton according claim 12 wherein an "in-line" punching mechanism is used to punch a base from a web of base material and additionally punch a susceptor/shielding material blank having similar shape and dimensions to said base from an adjacent web of susceptor/shielding material.

14. A carton according to claim 13 wherein the susceptor/shielding material is sandwiched between the layer of PET and the board substrate of which at least one of said base and said side wall of the carton is comprised.

15. A carton according to claim 14 wherein the susceptor/shielding material is provided only over a portion of the area of at least one of said base and said side wall such that subjecting the completed carton to microwave radiation will cause those portions to become hotter/remain colder than remaining portions of at least one of said base and said side wall.

16. A method of manufacturing a carton, said carton having a base and a side wall, both of said base and side wall being formed of card having a coating thereon which melts on heating, said base having a flange around its periphery to which said side wall may be adhered to form the carton, the method comprising the steps of first heating regions proximate an edge of the side wall by subjecting said regions to a blast of air at a temperature sufficient to melt said coating in said regions, and subsequently bringing said flange of said base into contact with said malted coating in said region, characterized in that the direction of air blast subtends an angle θ° with the plane containing the side wall, θ° being acute and the flange of the base being brought into contact with said region such that the coating is substantially unimpaired above the base internally of the carton, wherein said flange of said base is primarily bonded to said side wall at a uniform distance from the lowermost edge of said side wall such that said lowermost edge can be subsequently bent inwardly of said carton and urged and secondarily bonded against the surface of said flange opposite that surface which provides the primary bond; and wherein said secondary bond is effected by a base expander provided with a number of platens which, when disposed within the cavity defined by the lowermost surface of said base and the lowermost portion of said side wall, are urged outwardly bringing the prebent lowermost edge of said side wall into contact with the surface of said flange opposite that surface which provides said primary bond to form said secondary bond and simultaneously improving said primary bond by urging said flange of said base portion against said side wall portion in the region of said primary bond.

* * * * *

UNITED STATES PATENT AND TRADEMARK OFFICE

CERTIFICATE OF CORRECTION

PATENT NO. : 6,312,368 B1
DATED : November 6, 2001
INVENTOR(S) : Wood et al.

It is certified that error appears in the above-identified patent and that said Letters Patent is hereby corrected as shown below:

Column 7,
Line 6, change "gsid" to -- said --.

Column 8,
Line 21, change "malted" to -- melted --.

Signed and Sealed this

Twelfth Day of March, 2002

*Attest:*

*Attesting Officer*

JAMES E. ROGAN
*Director of the United States Patent and Trademark Office*